United States Patent [19]

Kanoto et al.

[11] 4,309,591

[45] Jan. 5, 1982

[54] HEATING AND FIXING DEVICE FOR TONER IMAGE

[75] Inventors: Masanobu Kanoto, Tokyo; Shigeru Ueda, Kamifukuoka, both of Japan

[73] Assignee: Canon Kabushiki Kaisha, Tokyo, Japan

[21] Appl. No.: 58,433

[22] Filed: Jul. 18, 1979

[30] Foreign Application Priority Data

Jul. 25, 1978 [JP] Japan ..... 53-90583
Jul. 25, 1978 [JP] Japan ..... 53-90584

[51] Int. Cl.[3] ..... H05B 1/00

[52] U.S. Cl. ..... 219/216; 219/370; 219/471; 219/505; 165/89; 355/110; 432/60

[58] Field of Search ..... 219/216, 369, 370, 371, 219/388, 469, 470, 471, 505; 432/60; 165/39, 47, 89; 355/35, 100, 110

[56] References Cited

U.S. PATENT DOCUMENTS 3,475,589 10/1969 Bartusek et al. ..... 219/216
3,820,591 6/1974 Sisson et al. ..... 165/39
3,936,658 2/1976 Traister et al. ..... 219/216
3,993,124 11/1976 Mueller ..... 165/89
4,127,764 11/1978 Minden ..... 219/216
4,212,631 7/1980 Franke et al. ..... 432/60

OTHER PUBLICATIONS

*IBM Journal of Research & Development*, "Paper Path of an On-Line Computer-Output Printer," R. A. Svendsen, vol. 22, No. 1, Jan. 1978.

*Primary Examiner*—Volodymyr Y. Mayewsky
*Attorney, Agent, or Firm*—Fitzpatrick, Cella, Harper & Scinto

[57] ABSTRACT

A fixing device in which a toner image support member is pressure-held between and conveyed by a pair of rollers at least one of which is heated to a temperature at which the toner image may be fixed on the support member, characterized in that the end of at least one of the rollers which tends to be higher in temperature is cooled or the opposite end of said at least one roller is supplied with heat, whereby the thermally expanded state of said at least one roller and the thermally expanded state of the other roller are maintained in such a condition that the toner image support member is not laterally displaced from a predetermined conveyance path.

24 Claims, 15 Drawing Figures

HEATING AND FIXING DEVICE FOR TONER IMAGE

BACKGROUND OF THE INVENTION

1. Field of the Invention

This invention relates to a device for heating and fixing a toner image on a support member.

2. Description of the Prior Art

A device in which a toner image support member is pressure-held between and conveyed by two rollers at least one of which is heated, thereby fixing the toner image is known. Usually, rotational force transmitting means including a member such as a gear is connected to the shaft on one end of one of the two rollers. The rotational force generated by a source of force such as an electric motor is transmitted through the transmitting means to rotatively drive said shaft and accordingly the roller having said shaft. The other roller is usually provided so that it is rotated by the friction force between it and the rotatively driven roller. In any case, the heat possessed by the roller is partly taken by the rotational force transmitting means. Accordingly, the temperature at the end of this roller to which is connected the rotational force transmitting means becomes lower than the temperature at the other end of the roller. A temperature difference created between the opposite ends of the roller results in a diameter difference between the opposite ends which is attributable to a thermal expansion amount difference. This causes a difference in pressure between the two rollers and between the opposite ends thereof. If such a difference becomes great, the toner image support member is wrinkled or moves obliquely or meanders and may be caught by various members provided along the conveyance path, thus resulting in jam or the like. Particularly, where the toner image support member is a long footage of continuous sheet used with a device for printing out the output of an electronic computer, a great temperature difference between the opposite ends of the roller causes the sheet to be laterally displaced from its regular path in the station for imparting the toner image to the continuous sheet (the position upstream of the fixing device with respect to the sheet conveyance) to laterally offset the position of the toner image imparted onto the sheet and in an extreme case, there occurs an inconvenience that the continuous sheet is severed. The long footage of continuous sheet is usually severed when it is laterally displaced by 1 mm or more from a predetermined conveyance path.

SUMMARY OF THE INVENTION

It is an object of the present invention to provide a heat roller type fixing device in which a toner image support member may be stably conveyed through a predetermined path.

It is another object of the present invention to provide a heat roller type fixing device in which a toner image support member in the form of a long footage of continuous sheet may be stably conveyed through a predetermined path.

It is still another object of the present invention to provide a heat roller type fixing device in which a toner image support member in the form of a long footage of continuous sheet may be conveyed without being severed.

It is yet still another object of the present invention to provide a heat roller type fixing device in which a toner image support member in the form of a long footage of continuous sheet may be conveyed without being displaced from a predetermined path in an image inparting step which is a step prior to fixation.

DESCRIPTION OF THE PREFERRED EMBODIMENTS

Figure 1:
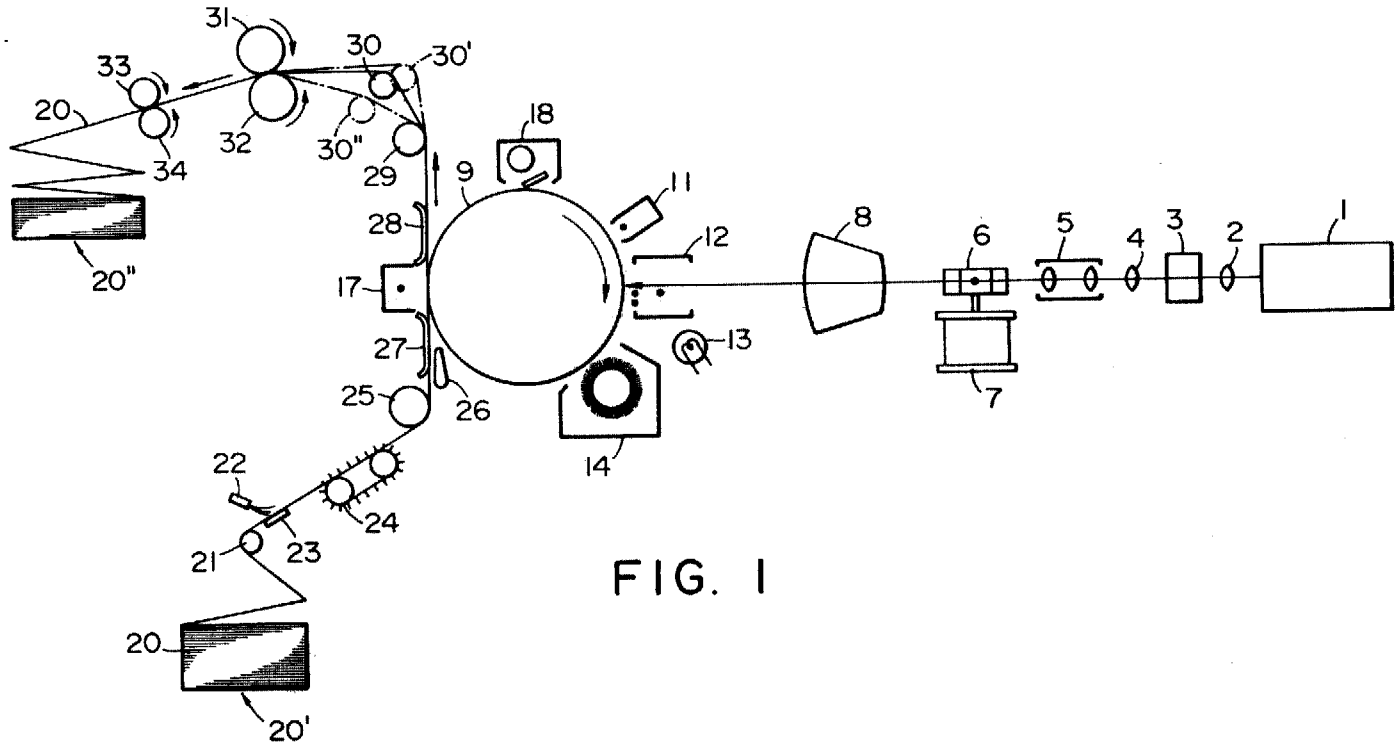
FIG. 1 illustrates a print-out apparatus for electronic computer output to which the fixing device of the present invention is applicable.

In FIG. 1, a laser beam emitted from a laser oscillator 1 enters a light modulating system constituted by a lens 2, a known A/O modulation element 3 to which the output signal of a computer is applied, and a lens 4. The beam modulated by this system in accordance with the said signal passes through a beam expander 5 and enters a polygon mirror 6 which is rotated by a motor 7. The beam swept by the rotating mirror 6 is converted into a parallel beam 8 by a lens 8 and impinges on a photosensitive drum 9.

The photosensitive drum 9 having on the peripheral surface thereof an electrophotographic sensitive medium comprising an electrically conductive back-up member, a photoconductive layer and a surface insulating layer in sccession is rotated at a constant velocity. As it is rotated, the photosensitive drum is first uniformly charged by a first corona discharger 11, and then subjected to AC corona discharge or DC corona discharge of the opposite polarity to that of the discharger 11 by a second corona discharger 12 while being irradiated by the said beam, whereafter it is uniformly illuminated over the whole surface thereof by a lamp 13. Through the above-described process, an electrostatic latent image of high contrast corresponding to the recorded signal of the computer is formed on the photosensitive medium, and the latent image is developed by a developing device 14 with the aid of thermally melting colorant particles (toner). At an image transfer station, the image so developed is transferred onto fan-folded paper 20 by an image transfer charger 17, the fan-folded paper 20 being a long footage of continuous paper which is conveyed in the direction of arrow at the same velocity as the peripheral velocity of the photosensitive drum 9 while being urged against the drum 9. The toner image so transferred is heated and fixed on the web of paper 20 by a fixing device which will hereinafter be described. On the other hand, after the image transfer, the photosensitive medium is cleaned by a cleaner 18, thus becoming ready for another cycle of image formation. Where the so-called Carlson method is used as the electrophotographic method, means 12 and 13 may be eliminated.

Description will now be made of the conveyance of the long footage of continuous paper 20. The paper 20 is of the type which is usually used for the output of a computer and has perforations at predetermined intervals longitudinally thereof to enable folding of the paper and also has feed apertures at the opposite side edges thereof. The paper 20 is fed from a container portion 20' for the stock of paper and is transported into a container portion 20'' after being subjected to image transfer and fixation. The paper 20 is continuous from the position 20' to the position 20''. A holding bar 21 is provided to assist smooth conveyance of the paper 20. A brush 22 is provided to urge the paper 20 against a guide plate 23 to prevent the paper 20 from floating when entering into a tractor 24, to be described, to thereby smooth the conveyance of the paper. The brush 22 also serves to remove dust or the like which sticks to the paper 20. The tractor 24 is of the known type which has arranged thereon pins for engaging the feed apertures of the paper 20, and the pins are rotated by rotation of a tractor shaft, not shown, to thereby convey the paper 20 at a constant speed in the direction of arrow. Thus, the paper 20 is prevented from widthwise displacement at the tractor position. Designated by 25 and 29 are guide rollers for conveying the paper.

Denoted by 27 and 28 are image transfer guide plates selectively movable between a shown first position and a second position more remote from the photosensitive medium than the first position for urging the paper 20 against the peripheral surface of the photosensitive drum substantially tangentially thereof at the shown first position. Of course, at the image transfer station, the paper 20 is conveyed along such a path that the desired toner image formed on the drum 9 can be transferred singly onto a predetermined widthwise section of the paper without jutting out of the widthwise limits of the paper. When the image transfer has been completed, the guide plates 27 and 28 are moved to their second position and the paper 20 is forced by a member 26 and separated from the drum 9. Designated by 30 is a guide roller which absorbs any variation in tension exerted on the paper 20 during the conveyance thereof to maintain the tension of the paper 20 constant, and which is movable between the shown dotted-line positions 30' and 30'' in accordance with the variation in tension of the paper. Denoted by 31 is a fixing roller against which the toner image bearing surface 20 is urged. Designated by 32 is a back-up roller. At least one of these two rollers is heated. The roller 31 and 32 are longer than the width of the paper 20 and convey the paper 20 by holding the same between the opposite ends thereof and heat and melt the toner image to fix it on the paper 20. The rollers 31 and 32 are rotated in the directions of arrows to convey the paper 20 at the same velocity as the peripheral velocity of the drum 9. Denoted by 33 and 34 are rollers for discharging to the container position 20'' the paper 20 having been subjected to the toner image fixation process.

Figure 2:
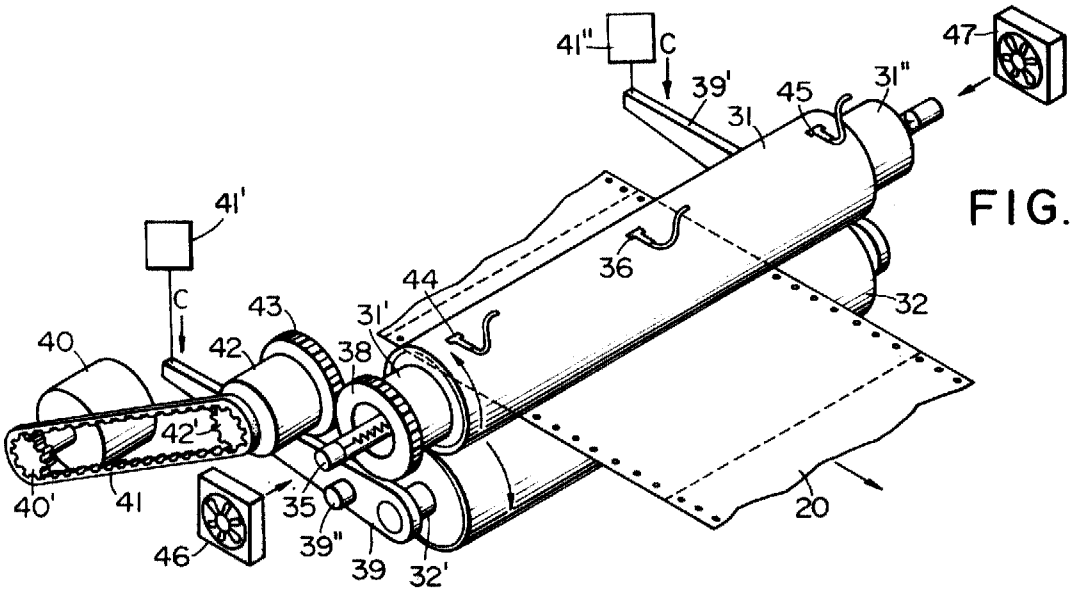
FIG. 2 is a perpective view of the device, without its side plates, for illustrating some embodiments of the present invention.

The fixing device will now be described in detail. In FIG. 2, rollers 31 and 32 are those described in connection with FIG. 1. The shown fixing roller 31 comprises a hollow cylindrical roll of aluminum having the surface thereof coated with a thin layer of tetrafluoroethylene resin to prevent toner offset. The shown back-up roller 32 comprises an aluminum core roll $32_1$ wrappled by a relatively thick layer of heat resistant silicone rubber $32_2$ and having the outermost surface coated with a tube of tetrafluoroethylene resin to prevent toner offset. When the paper 20 is pressure-held by and between the two rollers 31 and 32, the resilient material layer $32_2$ is resiliently deformed. Thus, the paper 20 is urged against the rollers 31 and 32 with some width with respect to the direction of conveyance thereof, so that the toner takes sufficient heat and is positively fixed on the paper. In the hollow of the fixing roller 31, there is secured, in any conventional manner (not shown), a heat source 35 such as an infrared lamp which remains turned on as long as the main switch of the print-out apparatus shown in FIG. 1 is closed, even if the fixing process is not taking place. The heat source 35 has a length substantially greater than the axial length of the body of the roller 31 (the cylindrical portion against which the paper 20 is urged) and heats the roller 31 throughout the entire length thereof (the heat distribution imparted to the roller 31 is bilaterally symmetrical, and preferably bilaterally uniform, with respect to the lengthwise direction of the roller), and heats the peripheral surface thereof to such a temperature that the toner is thermally molten to adhere to the paper 20 substantially throughout the entire length of the roller body at least in the range of contact of the paper 20. But the roller must not be heated to such a high temperature which will degenerate the paper. The temperature range of the peripheral surface of the roller 31 differs depending on the quality of the toner and the quality of the paper, but is usually in the range of 70° to 250° C. Designated by 36 is a temperature detecting element such as thermistor or the like which bears against the peripheral surface of the roller 31 substantially at the lengthwise center thereof. The signal from this element 36 is applied to a known control circuit to control the input to the heat source 35 so that the temperature of the peripheral surface of the roller 31 is normally within the above-mentioned set temperature range.

No heat source is present within the back-up roller 32, but the temperature of this roller 32 is raised by directly taking the heat from its contact portion with the roller 31 or directly through the paper 20 when the roller 32 is brought into a position wherein it cooperates with the roller 31 to hold the paper 20 therebetween, by a means which will hereinafter be described. (It is also possible to provide, within the back-up roller, a heat source similar to that within the roller 31.

Figure 3:
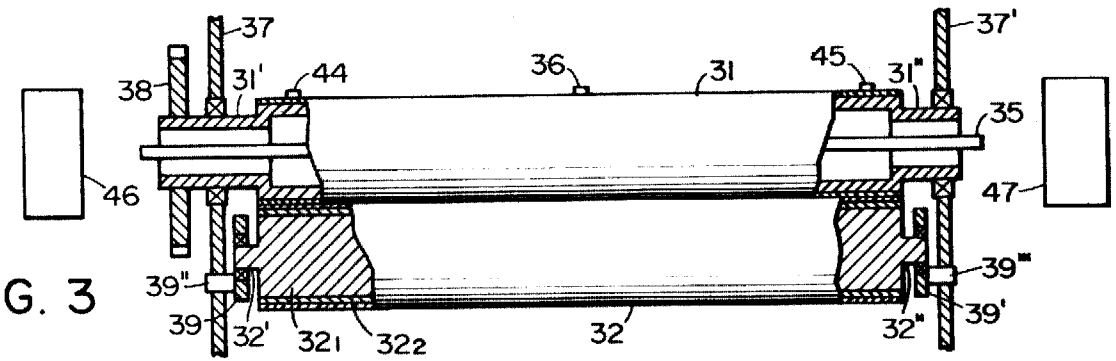
FIG. 3 is a partial section view of the rollers, side plates and drive mechanism.

As shown in FIG. 3, hollow shafts 31' and 31'' through which the heat source 35 extends are provided on the opposite ends of the fixing roller 31, and these shafts 31' and 31'' are rotatably journalled to the side plates 37 and 37' of the fixing device by means of adiabatic or low heat transfer bearings. The shafts 31' and 31'' partly extend outwardly of the side plates 37 and 37'. A gear 38 is fixed on that portion of the shaft 31' which juts out of the side plate 37. On the other hand, the back-up roller 32 is rotatably supported on a lever 39 by the shafts 32' and 32'' jutting out at the opposite ends thereof being fitted in the bearings (adiabatic or low heat transfer) of pressing levers 39 and 39'. The lever 39 is rotatably supported to the side plates 37 and 37' by means of support shafts 39'' and 39''' projectedly provided thereon. The ends of the levers 39 and 39' which are opposite to the roller 32 with respect to the shafts 39'' and 39''' are connected to electromagnetic plungers 41',41''. During the fixation process, the plungers are operated to force said ends of the levers 39 and 39' in the direction of arrows C. By this, the roller 32 urges the paper 20 against the roller 31.

The paper 20 is normally conveyed while being pressure-held by and between the rollers 31 and 32 with the widthwise center being coincident with the lengthwise center of the rollers 31 and 32. When the desired fixation process has been terminated, the aforementioned plungers are deenergized to thereby permit the roller 32 to lower from gravity by a predetermined distance and come out of engagement with the roller 31. When this occurs, the pressure-holding of the paper 20 by the two rollers 31 and 32 is released.

In FIG. 2, reference character 40 designates a motor for rotatively driving the fixing roller 31. The rotational force of the motor 40 is transmitted to the roller 31 through a mechanism which will hereinafter be described. Designated by 38 is the gear fixed on the shaft 31' of the roller 31 as previously described. A gear 43 fixed to the output shaft of a magnetic powder clutch 42 meshes with the gear 38. A timing pulley 42' is secured to the input shaft of the clutch 42. A timing belt 41 is passed over the pulley 42' and also over a timing pulley 40' secured to the output shaft of the motor 40. The magnetic powder clutch 42 is used as a slip clutch and provides constant velocity rotation of a predetermined torque with high accuracy. In any case, the rotational force of the motor 40 is transmitted to the means 40', 41, 42', 42, 43 and 38 in the named order to thereby rotatively drive the roller 31 at the same peripheral velocity as that of the drum 9. Among the various means constituting the above-described rotational force transmitting mechanism, the gear 38 secured on the shaft of the heated roller and the gear 43 meshing with the gear 38 may preferably be formed of a metal such as steel or brass with their heat resistivity taken into account. (However, metallic gears are good in heat conductivity and therefore tend to take heat from the roller and emit such heat outwardly.) The back-up roller 32 is rotated at the same peripheral velocity as the roller 31 by the friction between it and the roller 31 and the paper 20 when the roller 32 is urged against the roller 31 by the operation of the aforementioned plungers.

As described above, the metal gear 38 forming a part of the rotational force transmitting mechanism is provided on the shaft 31' of the fixing roller 31 and the heat at the end of the roller 31 which is adjacent to the shaft 31' is taken by the gear 38. The heat so taken is emitted from the surface of the gear 38 or transferred to the gear 43. The heat so transferred to the gear 43 also soon flows out from this gear. On the other hand, the shaft 31'' of the roller 31 is simply supported by a support plate 37' and is not connected to the aforementioned rotational force transmitting mechanism. Accordingly, the quantity of heat emitted from the end of the roller 31 which is adjacent to the shaft 31' is greater than the quantity of heat emitted from the opposite end of the roller 31. In this case, therefore, the end of the roller 31 which is adjacent to the shaft 31' tends to become lower in temperature than the opposite end, and accordingly, the end of the back-up roller 32 urged against the roller 31 which corresponds to the shaft 31' tends to become lower in temperature than the opposite end of the back-up roller 32. However, when there is a temperature difference between the opposite ends of at least one or particularly both of the fixing roller 31 and the back-up roller 32, the paper 20 becomes displaced from its predetermined path toward that end of the rollers which is higher in temperature. This is attributable to the fact that there is a difference in amount of thermal expansion of the roller diameter between the two ends.

Figure 4:
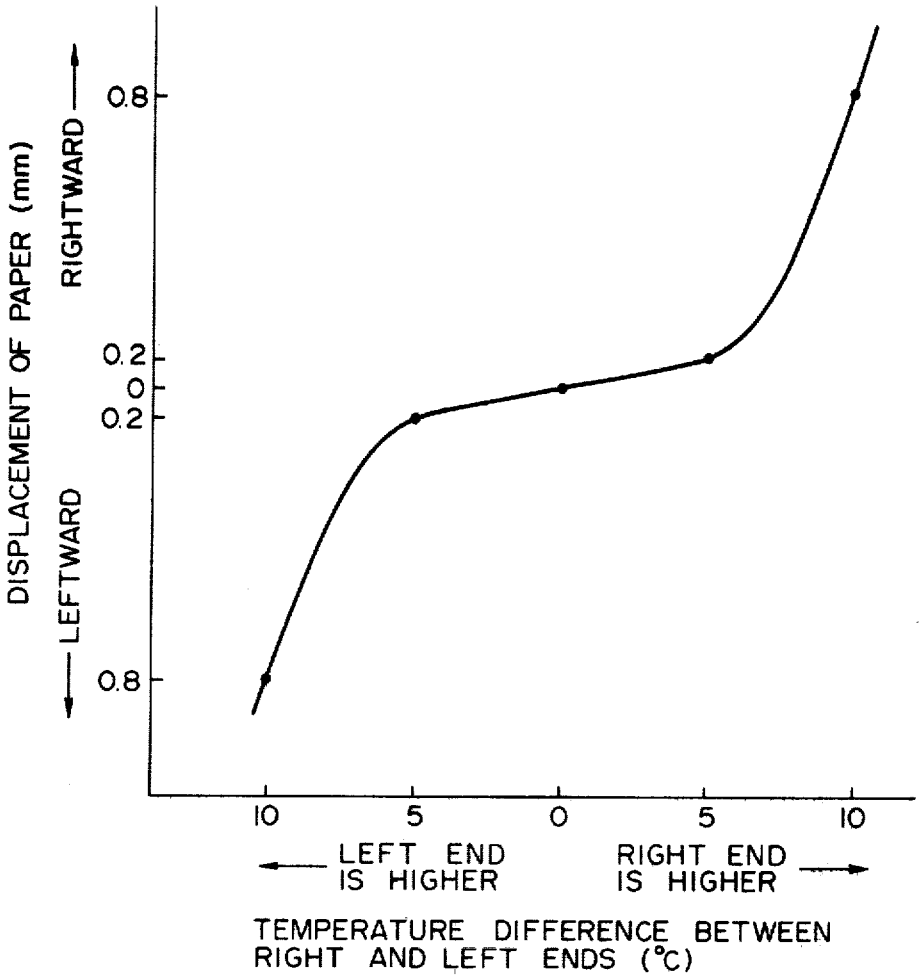
FIG. 4 is a graph illustrating the relation between the temperature difference between the opposite ends of the roller and the displacement of the toner image support member.

FIG. 4 is a graphical representation of the data obtained by measuring the temperature difference between the lengthwise left and right ends of the fixing roller 31 and the amount of displacement of the paper from its regular path (the path in which the widthwise center of the paper is coincident with the lengthwise center of the roller) with respect to the widthwise direction of the paper.

According to FIG. 4, when the temperature difference between the left and right ends of the roller is below 5° C., the displacement of the paper is sufficiently small (say, smaller than 0.2 mm) and there occurs no severance and wrinkling of the paper and practically sufficient printing accuracy is obtained, whereas when the temperature difference is higher than 5° C., the positional relationship between the paper 20 and the drum 9 becomes irregular (the paper displacement is 0.2 to 0.8 mm) at the image transfer station, if the paper is not severed, and sufficient printing position accuracy is not obtained. (But, if the required value of the printing accuracy is reduced, the temperature difference between the left and right ends of the roller 31 may be below 10° C.) Further, when there is a temperature difference of the order of 10° C. to 15° C., the paper will be greatly displaced and severed to cause jam. Therefore, the permissible range of temperature difference in this case is preferably below 5° C., and must not exceed the maximum 10° C. The data of FIG. 4 have been obtained by using paper having a thickness of 64 g/m$^2$, a fixing roller 31 having a diameter of 80 mm (the surface of which is heated to 190°–200° C.), and a back-up roller 32 having a diameter of 73 mm and having a silicone rubber layer as thick as 4 mm and with the two rollers 31 and 32 urged against each other with a pressure of 180 Kg and with the paper 20 conveyed at a velocity of 230 mm/sec. The permissible temperature difference between the opposite ends of the roller is of course variable with the set permissible range of paper displacement, the material, temperature, rotational speed and diameter of the roller pair and the strength of the paper. For example, in the present embodiment, the back-up roller 32 comprises a core metal coated with a relatively thick silicone rubber layer to provide a sufficient width of pressure contact between the rollers 31 and 32, and silicone rubber is greater in thermal expansion coefficient than the metal such as aluminum of the fixing roller 31. Therefore, the diameter of the back-up roller 32 differs from one end to the other even for a slight temperature difference and thus, where a material such as silicone rubber which has a relatively great thermal expansion coefficient is employed for both or one of the rollers 31 and 32, the temperature difference between the opposite ends of the rollers must be minimized. This also holds true with a case where each of the rollers 31 and 32 comprise a metal core only coated with a thin layer of offset preventing material such as tetrafluoroethylene resin.

In order to prevent the paper 20 from being severed and also prevent widthwise displacement of the paper 20 from its predetermined conveyance path which will allow the desired toner image to be transferred to the paper 20 at the image transfer station with a predetermined widthwise positional relationship of the toner image maintained, the embodiment of FIGS. 2 and 3 adopts the following means.

Designated by 47 is a blast fan. This blast fan 47 is provided so as to blow a cooling breeze against the portion of the shaft 31'' of the fixing roller 31 which juts outwardly of the side plate 37, the shaft 31'' being provided at the end opposite from the roller end which tends to become relatively low in temperature by being connected to the rotational force transmitting mechanism including the gear 38. This fan 47 begins to give a blast upon starting of the heating of the heat source 35 and stops giving a blast upon stoppage of the heating of the heat source. The heat radiation from the shaft 31'' is expedited by the breeze from the fan 47 and this results in lowered temperature of the end of the fixing roller 31 which is adjacent to the shaft 31''. The amount of blast per unit time of the fan 47 is set such that the amount of heat taken from the shaft 31'' by the blast per unit time is substantially equal to the amount of heat taken from the shaft 31' by the rotational force transmitting mechanism including the gear 38 per unit time. Thus, the temperature distribution in the fixing roller 31 with respect to the lengthwise direction thereof becomes substantially bilaterally symmetrical, so that the temperature difference between the opposite ends of the roller 31 is 0 or a small value within the permissible range. Accordingly, the temperature distribution in the back-up roller 32 with respect to the lengthwise direction thereof necessarily becomes substantially bilaterally synmetrical, so that the temperature difference between the opposite ends of this roller is 0 or a small value within the permissible range. In other words, the heat expansion difference between the opposite ends of the rollers 31 and 32 is substantially 0. Consequently, the paper 20 stably moves on the predetermined conveyance path without being severed, jammed and wrinkled and high printing accuracy is obtained at the image transfer station.

The fan 47 may be operated at a predetermined time interval. In such case, the fan 47 is caused to start operating before the temperature at the end of the fixing roller 31 which is adjacent to the shaft 31' becomes lower than the temperature at the end of the fixing roller which is adjacent to the shaft 31'' so that the temperature difference between the opposite ends of the fixing roller 31 (and accordingly, of the back-up roller 32) exceeds the permissible range, and is caused to stop operating before the temperature at the end of the roller 31 which is adjacent to the shaft 31'' becomes lower than the temperature at the end of the roller 31 which is adjacent to the shaft 31' so that the said temperature difference exceeds the permissible range. This time interval is set by a timer.

In the next embodiment, the temperature difference between the opposite ends of the roller is detected to correct the temperature difference therebetween in accordance with the detection. In FIGS. 2 and 3, reference numerals 44 and 45 designate temperature detectors such as thermistors or the like. These temperature detectors 44 and 45 bear against the peripheral surface of the fixing roller 31 body at the ends thereof which are adjacent to the shafts 31' and 31'', respectively.

Figure 5:
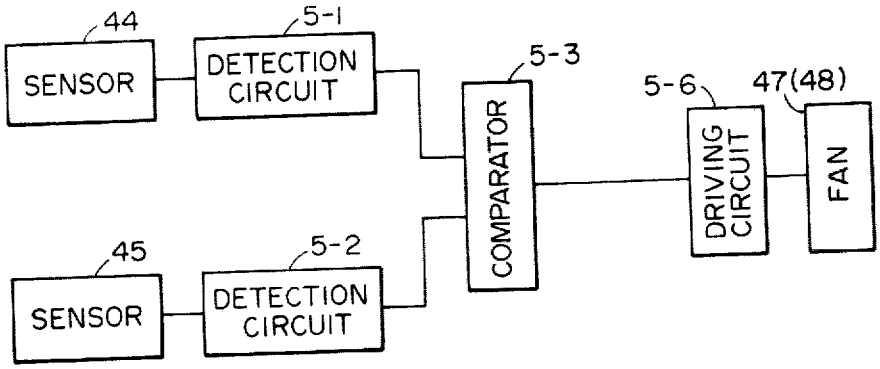
FIG. 5 illustrates an example of the control means.

Referring to FIG. 5, it includes detecting circuits 5-1 and 5-2 for converting variations in resistance value of the temperature sensors 44 and 45 into variations in voltage and detecting such variations, and a conventional comparator 5-3 for comparing the ouput voltages of the detecting circuits 5-1 and 5-2 and putting out a TTL level signal. The comparator 5-3 puts out a high level signal when the output voltage of the circuit 5-1 is higher than the output voltage of the circuit 5-2, and puts out a low level signal when the output voltage of the circuit 5-1 is lower than the output voltage of the circuit 5-2. Designated by 5-6 is a circuit for driving the fan 47. The circuit 5-6 drives the fan when the high level signal is applied thereto, and does not drive the fan when the low level signal is applied thereto.

When the temperature of the peripheral surface of the roller 31 at the end thereof which is adjacent to the temperature sensor 44 becomes lower than the temperature of the peripheral surface of the roller 31 at the end thereof which is adjacent to the sensor 45, the resistance value of the temperature sensor 44 becomes higher than that of the sensor 45. Accordingly, the output voltage of the detector 5-1 becomes higher than that of the detector 5-2, so that the output of the comparator assumes the high level. Consequently, the input signal of the fan driving circuit 5-6 assumes the high level. As a consequence, the fan 47 is driven so that the end portion of the roller 31 which is adjacent to the temperature sensor 45 is cooled down. At a point of time whereat the temperature of the end portion of the roller 31 which is adjacent to the temperature sensor 45 becomes slightly lower than the temperature of the end portion of the roller 31 which is adjacent to the sensor 44, due to the operation of the fan 47, the fan 47 stops operating as can be seen from what has been described above. The end portion of the roller 31 which is adjacent to the shaft 31'' again begins to rise in temperature due to the heat from the heater 35.

In the described manner, the temperatures at the opposite ends of the fixing and back-up rollers are controlled so as to be always the same. Thus, no diameter difference is created between the ends of the two rollers 31, 32 or if created, the diameter difference is within a permissible range and the paper 20 moves on the predetermined conveyance path.

Figure 6:
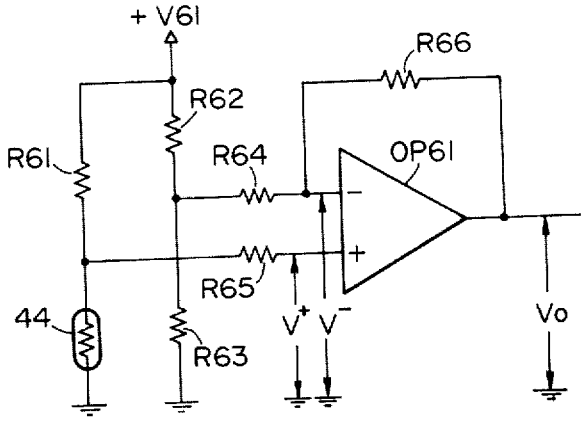
FIG. 6 illustrates an example of the detector circuit.

A specific example of the detecting circuit 5-1 is shown in FIG. 6, $R_{61}$, $R_{62}$, $R_{63}$, $R_{64}$, $R_{65}$ and $R_{66}$ are resistors and the resistance valves of the resistors $R_{64}$ and $R_{65}$ are set to sufficiently greater valves than those of the resistors $R_{63}$ and 44. OP 61 is a conventional operational amplifier, 44 designates the temperature detector, and V 61 is a predetermined voltage. Since the resistance valves of the resistors $R_{64}$ and $R_{65}$ are set to sufficiently greater valves than those of $R_{63}$ and 44, if $V^-$ is the potential at the negative (−) terminal of the operational amplifier OP 61 and $V^+$ is the potential at the positive (+) terminal of the operational amplifier, there are the following relations:

$$V^- = V61 \times R_{63} \div (R_{63} + R_{62}) = \text{constant} \quad (6\text{-}1)$$

$$V^{30} = V61 \times 44 \div (44 + R_{61}) \quad (6\text{-}2)$$

If $V_0$ is the output terminal voltage of the operational amplifier OP 61, $$V_0 = A \times (V^+ - V^-) \quad (6\text{-}3)$$

Assuming that the temperature of the portion in which the temperature detector 44 lies has risen, the resistance value of this detector 44 is decreased, so that from equation (6-2), the voltage $V^+$ to at the positive (+) terminal of the operational amplifier OP 61 drops. Accordingly, from equation (6-3), the output terminal voltage $V_0$ of the operational amplifier OP 61 drops. Conversely, when the temperature of the portion in which the temperature detector 44 lies falls, the resistance value of the detector 44 likewise rises and the output terminal voltage $V_0$ of the operational amplifier OP 61 rises.

In the described manner, the variation in temperature of the temperature detector 44 is replaced by the variation in the output terminal voltage $V_0$. The detecting circuit 5-2 may also be of the same construction as that shown in FIG. 6.

Figure 7:
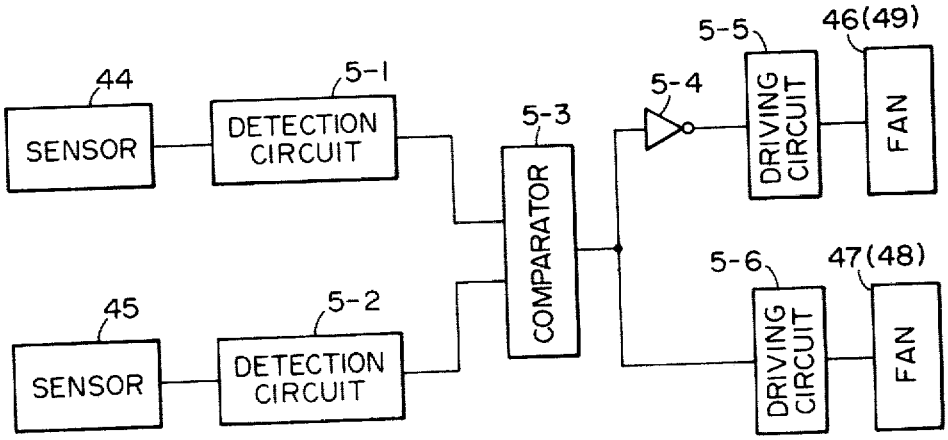
FIG. 7 illustrates an example of the control means.

In the described embodiment, only one cooling blast fan is used. However, in addition to the fan 47, a fan 46 for cooling the end portion of the roller 31 which is adjacent to the shaft 31' may be provided. If the opposite ends of the roller is so cooled by the fans, the temperature difference between the two ends may be quickly eliminated. FIG. 7 shows control means for the fans 46 and 47. The circuits common to the circuits described with respect to FIGS. 5 and 1 are given similar reference characters. In FIG. 7, reference character 5-4 designates a conventional inverter and 5-5 denotes a circuit for driving the fan 46. When a high level signal is applied to the driving circuit 5-5, it drives the fan 46 and when a low level signal is applied to the driving circuit 5-5, it does not drive the fan 46. As can be seen from the foregoing description, when the temperature at the end portion of the roller which is adjacent to the shaft 31'' becomes higher than the temperature at the end of the roller which is adjacent to the shaft 31', the fan 47 is operated. When the temperature at the end of the roller which is adjacent to the shaft 31'' becomes lower than the temperature at the end of the roller which is adjacent to the shaft 31' by the operation of the fan 47, the fan 46 is operated.

In the above-described embodiment, the wind formed by the fans 46 and 47 blows against the roller shafts 31' and 31'' projected outwardly of the side plates 37 and 37', but the wind does not blow against the bodies of the rollers 31 and 32, the shafts 32' and 32'' and the levers 39 and 39' because these are shielded by the side plates 37 and 37'. However, if, for example, the shaft 31'' is cooled down, the end of the body of the roller 31 (namely, the cylindrical body against which the paper 20 is urged) which is adjacent to the shaft 31'' is also cooled down and accordingly, the end of the body of the roller 32 which is adjacent to the shaft 32'' is also cooled down.

Figure 8:
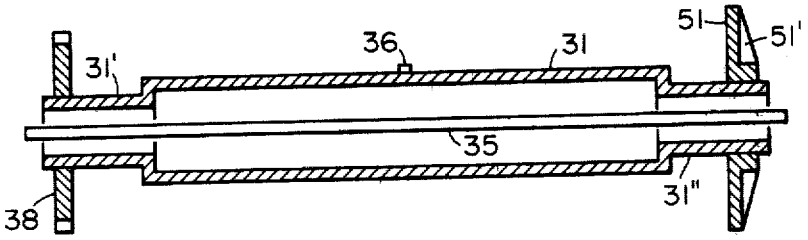
FIG. 8 illustrates another embodiment of the present invention.

FIG. 8 illustrates another embodiment of the present invention. Designated by 51 is a radiator plate secured to the shaft 31'' of the fixing roller and having a radiator fin 51'. This radiator plate 51 takes heat from the shaft 31'' and emits such heat, and the amount of heat emitted therefrom per unit time is substantially equal to the amount of heat emitted per unit time from the rotational force transmitting mechanism including the rear gear 38 which takes heat from the shaft 31'. Accordingly, the amounts of heat escaping from the opposite ends of the fixing roller 31 are substantially equal to each other and the temperature difference between these ends and therefore, the temperature difference between the opposite ends of the back-up roller 32 is 0 or a small value within the permissible range. In short, the difference in amount of thermal expansion between the opposite ends of the fixing and back-up rollers is substantially 0.

In the above-described embodiment, the end of the roller 31 which is adjacent to the shaft 31'' is cooled, but it is also possible to apply more heat to the end of the roller which is adjacent to the shaft 31' than to the end of the roller which is adjacent to the shaft 31''.

Figure 9:
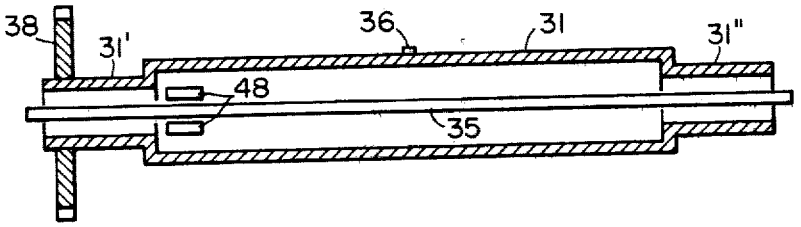
FIG. 9 illustrates still another embodiment of the present invention.

In FIG. 9, reference character 48 designates an auxiliary heat source disposed in the end of the hollow of the roller 31 which is adjacent to the shaft 31' so as to heat this end of the roller 31 body (or more particularly, so that the amount of heat imparted to the end of the roller 31 which is adjacent to the shaft 31' may be greater than that imparted to the end of the roller 31 which is adjacent to the shaft 31''). (Hereinafter, heating one end of the roller means that the amount of heat imparted to said one end of the roller is greater than the amount of heat imparted to the other end of the roller.) The auxiliary heat source 48 begins to heat upon starting of the heating of the main heat source 35 and stops heating upon stoppage of the heating of the main heat source 35. The amount of heat emitted from the heat source 48 per unit time is set such that the amount of heat imparted per unit time from this heat source 48 to the end of the roller 31 which is adjacent to the shaft 31' is substantially equal to the amount of heat taken per unit time from the shaft 31' by the rotational force transmitting mechanism including the gear 38. By this, the temperature distribution in the fixing roller is substantially bilaterally symmetrical with respect to the lengthwise direction of the roller and the temperature difference between the opposite ends of the roller 31 becomes 0 or a small value within the permissible range. This also holds true with the back-up roller 32. That is, the difference in amount of thermal expansion between the opposite ends of the rollers 31 and 32 is substantially 0. As the result, the paper 20 stably moves on the predetermined conveyance path without being severed, jammed and/or wrinkled and high printing acuracy is obtained at the image transfer station.

In this embodiment, the auxiliary heat source 48 is designed to heat as long as main heat source 35 heats, whereas the auxiliary heat source may also be controlled to heat at a predetermined time interval. In this case, the auxiliary heat source 48 is controlled by a timer so as to heat before the end of the fixing roller 31 which is adjacent to the shaft 31' becomes lower in temperature than the opposite end of the fixing roller and the temperature difference between the opposite ends of the fixing roller 31 (and accordingly, of the back-up roller 32) exceeds the permissible range, and to stop heating before the temperature at the end of the roller which is adjacent to the shaft 31' becomes higher than the temperature at the opposite end of the roller due to the action of the heat source 48 and the temperature difference exceeds the permissible range.

In the fixing device wherein the roller end which is adjacent to the shaft 31'' is cooled down as previously described, the temperature distribution with respect to the lengthwise direction of the roller takes a mountain-like shape in which the central portion is higher than the opposite ends, but in the fixing device wherein more heat is imparted to the end of the roller which is adjacent to the shaft 31' than to the end of the roller which is adjacent to the shaft 31'', the temperature distribution becomes flat. A device in which the temperature distribution can be made further flat will now be described by reference to FIG. 10.

Figure 10:
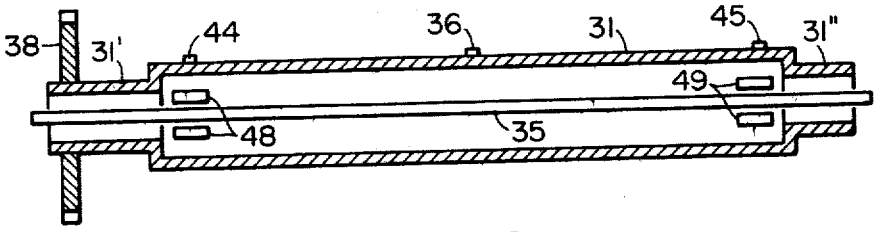
FIG. 10 illustrates other several embodiments of the present invention.

Designated by 48 and 49 in FIG. 10 are auxiliary heat sources disposed in the opposite ends of the hollow of the fixing roller 31 for heating the ends of the fixing roller 31 body which are adjacent to the shafts 31' and 31", respectively. The auxiliary heat sources 48 and 49 cooperate with the main heat source 35 to substantially uniformize the temperature distribution with respect to the lengthwise direction of the fixing roller 31 from end to end.

The amount of heat emitted by the auxiliary heat source 49 per unit time is smaller than that emitted by the auxiliary heat source 48 per unit time. The difference in amount of heat emitted per unit time between the auxiliary heat sources 48 and 49 is substantially equal to the amount of heat taken per unit time from the shaft 31' by the rotational force transmitting mechanism including the gear 38. In the present embodiment, the auxiliary heat sources 48 and 49 begin operating and stop operating in synchronism with the main heat source 35 and heat with the main heat source 35 as long as the latter is heating.

In FIG. 10, it is also possible to control the auxiliary heat sources 48 and 49 so that the heat source 48 heats in synchronism with the heating of the main heat source 35 while the auxiliary heat source 49 heats at a predetermined time interval. In this case, the length of time during which the heat source 49 stops heating and the length of time during which the heat source 49 heats are set to correspond to the difference between the amount of heat escaping from the end of the roller 31 which is adjacent to the shaft 31" through the shaft 31" and the amount of heat escaping from the end of the roller 31 which is adjacent to the shaft 31' through the shaft 31' (and accordingly, through the gear 38, etc.), and the temperature difference between the opposite ends of the roller 31 becomes 0 or a small value within the permissible range, as is apparent from what has been described already. In the latter embodiment mentioned with respect to FIG. 10, that end of the roller at which the temperature becomes relatively high is not forcibly cooled by the fan but this end of the roller is naturally cooled down by stoppage of the heating of the auxiliary heat source 49.

Figure 11:
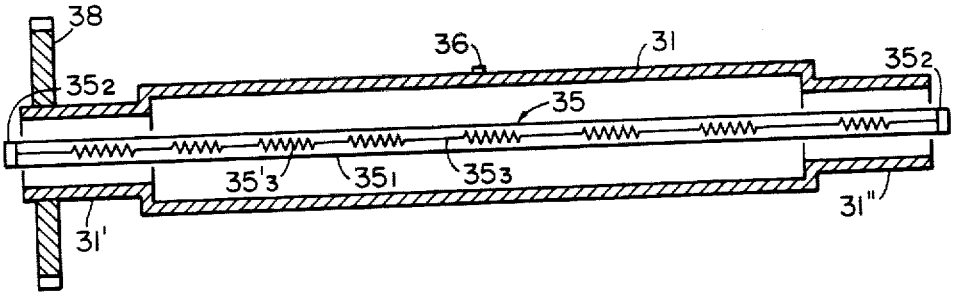
FIG. 11 is an illustration of another embodiment of the present invention.

FIG. 11 illustrates still another embodiment of the present invention. In this embodiment, the distribution of the amount of heat emitted from the main heat source 35 is greater at the side of the roller 31 which is adjacent to the shaft 31' than at the opposite side with respect to the lengthwise direction thereof. The main heat source 35 comprises a heat resistant glass tube $35_1$, insulator members $35_2$ secured to the opposite ends thereof, and a nichrome wire $35_3$ stretched between the insulator members $35_2$. The nichrome wire $35_3$, which heats upon electrical energization, has coiled portions $35_3'$ emitting more heat per unit length than the straight portions, the coiled portions being disposed at intervals. In the present embodiment, the lengths of the coiled portions $35_3'$ are equal to each other, but the intervals therebetween are smaller toward the shaft 31' side and greater toward the shaft 31" side. Therefore, more heat is imparted to the shaft 31' side of the roller 31 than to the shaft 31" side, whereby the temperature difference between the opposite ends of the roller 31 may be held within the permissible range.

Even in the device wherein more heat is imparted to the end of the roller which is adjacent to the shaft 31' than to the end of the roller which is adjacent to the shaft 31", it is possible to detect the temperature difference between the opposite ends of the roller 31 and correct the temperature difference in accordance with the detection. In this case, for example, as shown in FIGS. 2, 3 and 10, temperature detectors 44 and 45 may bear against the peripheral surface of the end of the roller 31 which is adjacent to the shaft 31' and the peripheral surface of the end of the roller which is adjacent to the shaft 31".

When the auxiliary heat source 49 is not provided but the auxiliary heat source 48 alone is provided, use may be made of control means formed by replacing the fan 47 by the heat source 48 in FIG. 5. Thus, when the temperature detected by the detector 44 becomes lower than the temperature detected by the detector 45, the output of the comparator 5-3 assumes a high level so that the circuit 5-6 causes the heat source 48 to heat the end of the roller 31 which is adjacent to the shaft 31'. When the temperature at the end of the roller 31 which is adjacent to the shaft 31' becomes slightly higher than the temperature at the end of the roller which is adjacent to the shaft 31" due to the action of the heat source 48, then the output of the comparator 5-3 assumes a low level so that the circuit 5-6 causes the heat source 48 to stop heating. Thereafter, the heat at the end of the roller 31 which is adjacent to the shaft 31' escapes through the shaft 31' and the gear 38. Thus, the temperature difference between the opposite ends of the roller 31 and the temperature difference at the opposite ends of the roller 32 are held to 0 or within the permissible range and accordingly, the difference in thermal expansion between the ends of the roller 31 and the difference in thermal expansion between the ends of the roller 32 both become substantially 0.

Where the auxiliary heat source 49 is provided in addition to the auxiliary heat source 48, use may be made of a control circuit in which the fans 46 and 47 are replaced by the heat sources 49 and 48 in the circuit of FIG. 7. If, then, the signal from the comparator 5-3 is a high level, the heat source 48 heats the end of the fixing roller 31 which is adjacent to the shaft 31', and if the signal from the comparator 5-3 is a low level, the heat source 49 heats the end of the fixing roller 31 which is adjacent to the shaft 31". Thus, the temperature difference between the opposite ends of the rollers 31 and 32 is maintained within the permissible range and the paper 20 moves on the predetermined conveyance path.

In the foregoing embodiment, the auxiliary heat sources 48 and 49 are inoperative in normal conditions, namely, when the temperature difference between the opposite ends of the roller 31 is within the permissible range, but the converse may also be possible. That is, the temperature distribution in the fixing roller 31 with respect to the lengthwise direction thereof often becomes mountain-shaped if bilaterally symmetrical when the long heat source 35 alone is used, and the central portion often becomes higher in temperature than the opposite end portions. Therefore, in order to substantially uniformize the temperature distribution in the roller 31 throughout the entire lengthwise direction thereof, it is possible to control the auxiliary heat sources 48 and 49 such that they are normally operative as long as the temperature difference between the opposite ends of the roller is within the permissible range and when a temperature difference exceeding the permissible range occurs between the opposite ends of the roller, the auxiliary heat source provided on that end of the roller which is higher in temperature stops operating and that end of the roller is naturally cooled down.

In the various devices wherein the position of the continuous paper 20 at the portion thereof pressure-held by the rollers 31 and 32 with respect to a direction perpendicular to the paper conveyance direction is directly detected by detecting the temperature difference between the opposite ends of the roller 31 and the temperature difference is corrected in accordance with the detection, the temperature difference between the left and right ends of the roller 31 may always be held below 5° C. to realize very stable conveyance of the paper and very stable printing accuracy and very good fixation of toner image.

On the other hand, in case where the conveyance speed of the paper 20 is made higher, it is known that there is the necessity of increasing the thickness of the silicone rubber layer of the back-up roller 32 and increasing the width of contact between the fixing roller 31 and the back-up roller 32 in order to ensure fixation of toner. When the thickness of the silicone rubber layer of the back-up roller 32 is great, as can be seen from what has been previously described, the apparent thermal expansion rate of the back-up roller 32 is great and the difference in diameter between the left and right end portions of the back-up roller 32 resulting from the temperature difference between the left and right end portions of the fixing roller 31 becomes greater. It is therefore necessary to make smaller the permissible limit of the temperature difference between the left and right end portions of the fixing roller 31.

According to an experiment, when the thickness of the silicone rubber layer of the back-up roller 32 is 12 mm, for example, the permissible limit of the temperature difference between the left and right end portions of the fixing roller 31 for which the paper is not displaced more than 0.2 mm from the predetermined conveyance path with respect to the widthwise direction has been about 2° C. It is difficult to hold the temperature difference between the left and right end portions of fixing roller 31 to 2° C. by only using the temperature sensors 44 and 45 described with respect to the foregoing embodiments, because there is the influence of paper dust or toner sticking to these. In such a case, the widthwise displacement of the paper during the conveyance thereof may be directly detected as shown in the example of FIGS. 12 and 13, instead of being indirectly detected as in the previously described embodiment, to thereby control the temperature at the ends of the fixing roller 31.

Figure 12:
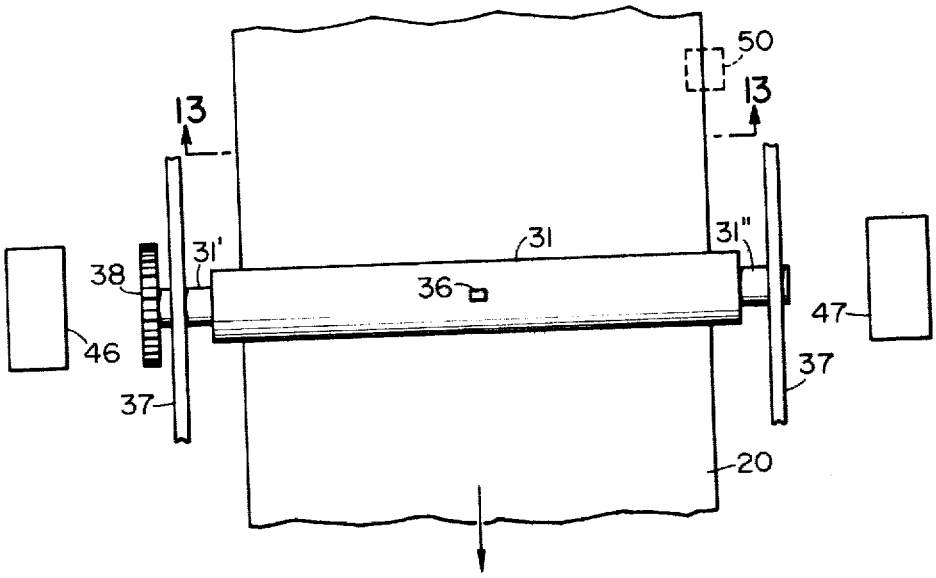
FIG. 12 is a plan view of another embodiment of the present invention.

FIG. 12 is a plan view of a fixing device generally similar in construction to that shown in FIGS. 2 and 3, and in this example, the temperature sensors 44 and 45 are omitted. Instead, a detector 50 for detecting the end position of the paper 20 is disposed upstream of the fixing and back-up rollers with respect to the direction of paper conveyance. Of course, the detector 50 may alternatively be disposed downstream of the pressure contact portion with respect to the direction of paper conveyance. As a further alternative, the detector 50 may be disposed at a position adjacent to the image transfer station of FIG. 1. Further, the detector 50 may be disposed on either of the right end side or the left end side of the width of the paper or on both of these.

Figure 13:
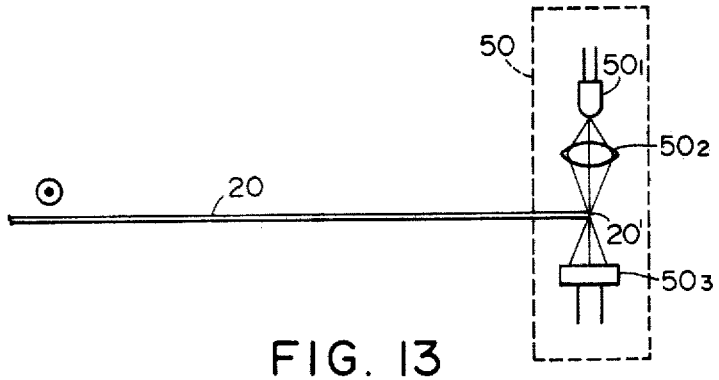
FIG. 13 is a section view taken along line 13—13 of FIG. 12.

As shown in FIG. 13, the detector 50 comprises a light source $50_1$ such as light-emitting diode, an image forming lens $50_2$ and a photoelectric conversion element $50_3$ such as solar cell. The optic axis of the lens $50_2$ is perpendicular to the paper 20, and the optic axis passes through the widthwise edge 20' of the paper when the widthwise center axis of the paper 20 is coincident with the center between the opposite ends of the fixing and back-up rollers. The light source $50_1$ is disposed on the optic axis of the lens $50_2$ and the edge 20' of the paper passes through the position of the image of the light source $50_1$ formed by the lens $50_2$. The element $50_3$ receives the light from the light source $50_1$ through the lens $50_2$. As is apparent from the foregoing, the quantity of light entering the element $50_3$ corresponds to the position of the edge 20' of the paper 20, namely, the amount of displacement of the paper 20 in the width direction thereof (the left to right direction in the drawing sheet of FIG. 13). During the conveyance of the paper, when the output of the photoelectric conversion element $50_3$ is higher than a prescribed level, it indicates that the paper 20 is displaced leftwardly of the predetermined conveyance path in FIG. 13 (toward the shaft 31' side). Conversely, when the output of the element $50_3$ is lower than the prescribed level, it indicates that the paper 20 is displaced rightwardly (toward the shaft 31" side). When the paper is displaced rightwardly of the predetermined conveyance path, the right-hand fan 47 is operated and when the paper is displaced leftwardly, the left-hand fan 46 is operated to thereby correct the displacement for the same reason as that described with respect to FIGS. 2 and 3.

Figure 14:
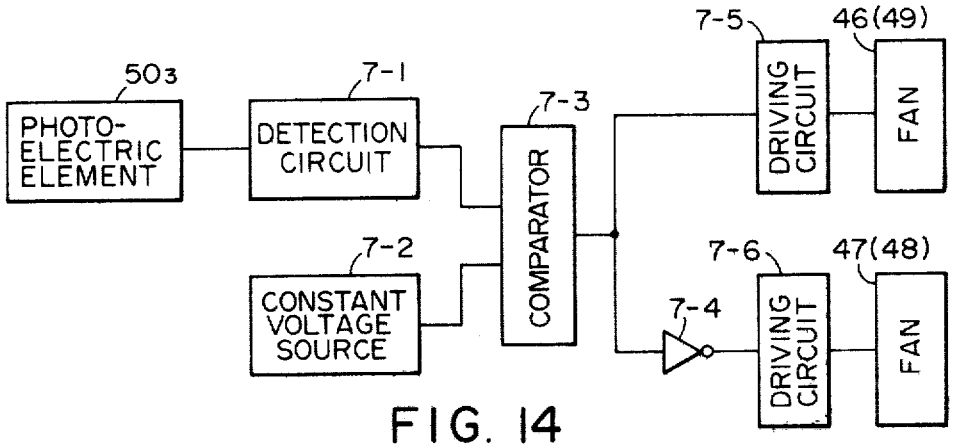
FIG. 14 illustrates an example of the control means.

FIG. 14 illustrates a circuit utilizing the output signal of the photoelectric conversion element $50_3$ to control the fans 46 and 47. The circuit of FIG. 14 includes a detection circuit 7-1 for converting the current variation of the element $50_3$ into a voltage variation, and a constant voltage source 7-2 whose voltage value is equal to the voltage value of the detection circuit 7-1 when the paper edge 20' is coincident with the optic axis of the lens $50_2$. FIG. 14 further includes a conventional comparator 7-3 for comparing the output voltage of the detection circuit 7-1 with the voltage value of the constant voltage source 7-2 and putting out the result of the comparison in a form of TTL level signal. The comparator 7-3 puts out a high level signal when the voltage of the detection circuit 7-1 is higher than the voltage of the constant voltage source 7-2, and puts out a low level signal when the voltage of the detection circuit 7-1 is lower than the voltage of the constant voltage source 7-2. The circuit of FIG. 14 further includes a conventional inverter 7-4 and driving circuits 7-5 and 7-6 for driving the fans 46 and 47 by the signal input of TTL level applied thereto. When the high level signal is applied as input to the driving circuits, they drive the fans and when the low level signal is applied as input thereto, they do not drive the fans.

In FIG. 13, if the paper meanders rightwardly, the quantity of light entering the photoelectric conversion element $50_3$ is decreased and therefore, the current generated by the element $50_3$ is decreased. Accordingly, the output voltage of the detection circuit 7-1 becomes lower than the output voltage of the constant voltage source 7-2, so that the output of the comparator 7-3 becomes a low level signal of TTL level. Accordingly, a low level signal is applied to the fan driving circuit 7-5 and a high level signal is applied to the fan driving circuit 7-6, so that the fan 47 is driven to cool the end portion of the fixing roller which is adjacent to the shaft 31" and the temperature at the corresponding end of the back-up roller also falls as a matter of course, and thus the displacement of the paper from its predetermined path is corrected. Conversely, when the paper is displaced leftwardly, the fan 46 is driven to cool the end portion of the fixing roller which is adjacent to the shaft 31' and the temperature at the corresponding end of the back-up roller falls as a matter of course, and thus the displacement of the paper from its predetermined path is corrected.

In the described manner, control is effected so that the paper always moves on its predetermined conveyance path.

Figure 15:
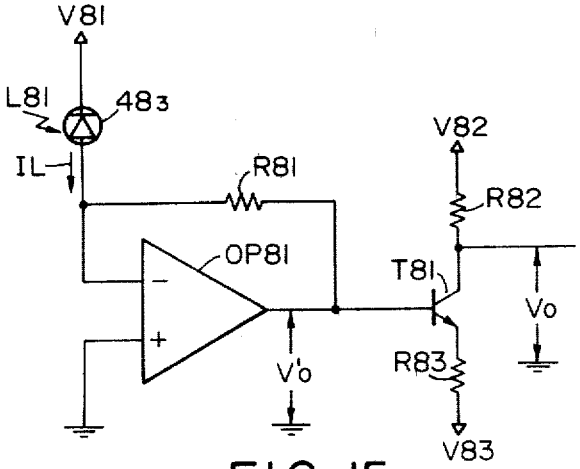
FIG. 15 illustrates an example of the detection circuit.

A specific example of the detection circuit is shown in FIG. 15. $R_{81}$, $R_{82}$ and $R_{83}$ are resistors and the resistance value of $R_{82}$ is equal to that of $R_{83}$. OP 81 designates a conventional operational amplifier. T 81 denotes a conventional NPN type transistor, V 81 and V 82 indicate positive constant voltages. V 83 indicates a negative constant voltage. L 81 represents the quantity of light entering the detector $\mathbf{48}_3$.

Let $I_L$ be the current flowing through the detector $\mathbf{48}_3$. Then, $I_L$ is generally represented as follows:

$$L_L = A \times L\ \mathbf{81}\ \text{(A is a constant)} \quad (8\text{-}1)$$

$I_L$ also flows through the resistor $R_{81}$ and if the output terminal voltage of the operational amplifier OP 81 is $V_0'$, $$V_0' = -R_{81} \times I_L \quad (8\text{-}2)$$

Since $R_{82} = R_{83}$, the transistor T 81 acts as a mere inverter and if the output terminal voltage of the transistor T 81 is $V_0$, $$V_0 = R_{81} \times I_L = A \times R_{81} \times L_{81} \quad (8\text{-}3)$$

Consequently, the output terminal voltage $V_0$ of the transistor T 81 is proportional to the quantity of incident light L 81 on the detector $\mathbf{48}_3$.

As previously noted, the end of the roller 31 which is adjacent to the shaft 31' tends to be lower in temperature than the end of the roller 31 which is adjacent to the shaft 31''. Therefore, in most cases, the paper 20 is displaced from the predetermined conveyance path toward the shaft 31'' side. Therefore, means 7-5 and 46 may be eliminated in FIG. 14.

Also, if the auxiliary heat sources 48 and 49 described in connection with FIG. 10 are replaced by the fans 47 and 46 of FIG. 14, the auxiliary heat sources 48 and 49 may be controlled by the detector 50. When the quantity of light incident on the photoelectric conversion element $\mathbf{50}_3$ is decreased below the set quantity corresponding to the voltage of the voltage source 7-2, namely, when the paper is displaced rightwardly, the heat source 48 is operated to heat the end portion (left end portion) of the fixing roller 31 which is adjacent to the shaft 31' and at the same time, the left end portion of the back-up roller also rises in temperature, so that the above-described displacement of the paper is corrected. On the other hand, when the paper is displaced leftwardly in FIG. 13, the heat source 49 is operated to heat the end portion (right end portion) of the fixing roller 31 which is adjacent to the shaft 31'' and at the same time, the right end portion of the back-up roller also rises in temperature, so that the above-described displacement of the paper is corrected.

Further, as described in connection with FIG. 10, even in the embodiment using the paper edge position detector 50 and the auxiliary heat sources 48, 49, the auxiliary heat sources 48, 49 may be left operative to uniformize the temperature distribution in the fixing roller with respect to the lengthwise direction thereof as long as the displacement of the paper from its predetermined conveyance path does not occur, and one of the heat sources 48 and 49 may be deenergized only when the output of the detector $\mathbf{50}_3$ becomes greater or smaller than the set value, to thereby naturally cool the roller 31 and accordingly cause the corresponding end of the back-up roller to fall in temperature, thus correcting the displacement of the paper.

Also, the means 7-5 and 49 may be eliminated in FIG. 14 for the same reason as that previously described. Further, the paper edge position detector may alternatively be a non-contact type one comprising a ultrasonic wave oscillator and a receiver, or may be a contact type one using a microswitch or the like. Also, detection may be made of the position of the paper feeding apertures.

In the above-described embodiment, design is made such that the temperature difference not between the opposite ends of the back-up roller 32 but between the opposite ends of the fixing roller 31 is first controlled, as a result of which the temperature difference between the opposite ends of the back-up roller 32 is held within the permissible range. This is attributable to the reasons that the fixing roller 31 is provided for rotation at a predetermined position which leads to the ease with which the fans, the auxiliary heat sources and the like are disposed, that during the interrupted fixing process, namely, during the stoppage of the paper conveyance, the back-up roller 32 is spaced apart from the fixing roller 31 and no temperature difference arises between the opposite ends of the back-up roller 32 during that time, that in contrast, a temperature difference tends to arise between the opposite ends of the fixing roller 31 having therewithin a heat source (which heats as long as the main switch of the print-out apparatus is closed) and having connected thereto the rotational drive force transmitting mechanism, and that when a temperature difference arises between the opposite ends of the fixing roller 31 and the back-up roller 32 is urged against the roller 31 to resume the fixing process, a temperature difference inconveniently and suddenly arises between the opposite ends of the back-up roller 32. The sensors 44 and 45 are applied to the roller 31 substantially for the same reasons as those stated above.

Means for heating or cooling the roller end which is similar to that described above may of course be provided for the back-up roller, and such means may be provided for both of the fixing and back-up rollers. The former is useful where the heat source lies not within the fixing roller but within the back-up roller, and the latter is useful where both of the fixing and back-up rollers have heat sources therewithin. For simplicity, only the fixing roller 31 is shown in FIGS. 8, 9, 10 and 11, whereas it is to be understood that this fixing roller is combined with the back-up roller 32 as shown in FIGS. 2 and 3.

The present invention is particularly useful for the fixation of toner images formed on a long footage of continuous sheet as mentioned previously, and it may of course be effectively utilized for the fixation of toner images formed on cut sheets. The present invention is useful not only for the fixation in the output printing apparatus of an electronic computer but also for the fixation in general apparatuses for forming toner images.

The present invention is also applicable to a fixing device in which the heat source is provided not within the fixing roller but within the back-up roller. The present invention is further applicable to a fixing device having a heat source provided not interiorly but exteriorly of the roller, and the auxiliary heat source may be provided exteriorly of the roller.

What we claim is:

1. A device for heating and fixing a toner image on a support member, comprising:

first and second rollers, at least one of which is thermally expansible, for pressure-holding the toner image support member therebetween and conveying the same;

means for supporting said first and second rollers;

means for transmitting a drive force from a drive source to at least one of said first and second rollers;

heating means for heating at least one of said first and second rollers to a temperature at which the toner image is fixed on said support member; and means for adjusting the temperature difference between the opposite ends of at least one of said first and second rollers to render the thermal expansion amount difference between the opposite ends of said first and second rollers to substantially zero in order to prevent said toner image support member from being displaced transversely from a predetermined conveyance path.

2. A device for heating and fixing a toner image on a support member, comprising:

first and second rollers, at least one of which is thermally expansible, for pressure-holding the toner image support member therebetween and conveying the same;

means for supporting said first and second rollers;

heating means for heating at least one of said first and second rollers to a temperature at which the toner image may be fixed on said support member;

rotational force transmitting means connected to a shaft on a first end of said first roller, said means being effective to transmit to said first roller the rotational force generated by a driving source to rotatively drive said first roller, and adjusting means for cooling a second end of said first roller which is opposite to said first end, said adjusting means being effective to take from said second end of said first roller an amount of heat corresponding to the amount of heat taken by said rotational force transmitting means from said first end of said first roller, thereby holding the thermally expanded states of said first and second rollers in such a condition that the toner image support member is prevented from being displaced transversely from a predetermined conveyance path.

3. The device according to claim 2, wherein said adjusting means is continuously operative during the operation of said heating means.

4. The device according to claim 2, wherein said adjusting means is intermittently operative during the operation of said heating means.

5. The device according to claim 2, wherein said adjusting means includes a radiator member connected to the shaft on the second end of said first roller.

6. A device for heating and fixing a toner image on a support member, comprising:

first and second rollers, at least one of which is thermally expansible, for pressure-holding the toner image support member and conveying the same;

means for supporting said first and second rollers;

main heating means for heating at least one of said first and second rollers to a temperature at which the toner image may be fixed on the support member;

rotational force transmitting means connected to the shaft on a first end of said first roller, said means being effective to transmit to said first roller the rotational force generated by a driving source to rotatively drive said first roller; and adjusting means, including auxiliary heating means, for supplying a greater amount of heat to said first end of said first roller than to a second end of said first roller which is opposite to said first end, thereby holding the thermally expanded state of said first and second rollers in such a condition that the toner image support member may be prevented from being displaced transversely from a predetermined conveyance path.

7. The device according to claim 6, wherein said auxiliary heating means is continuously operative during the operation of said main heating means.

8. The device according to claim 6, wherein said auxiliary heating means is intermittently operative during the operation of said main heating means.

9. The device according to claim 6, wherein said main heating means produces a greater amount of heat on the side corresponding to said end of said first roller than on the side corresponding to the other end of said first roller and serves also as said auxiliary heating means.

10. The device according to claim 6, wherein said auxiliary heating means comprises first auxiliary heating means for heating said first end of said first roller and second auxiliary heating means for heating said second end of said first roller, said second auxiliary heating means being intermittently operative during the operation of said main heating means.

11. A device for heating and fixing a toner image on a support member, comprising:

first and second rollers, at least one of which is thermally expansible, for pressure-holding the toner image support member therebetween and conveying the same;

means for supporting said first and second rollers;

means for transmitting a drive force from a drive source to at least one of said first and second rollers;

heating means for heating at least one of said first and second rollers to a temperature at which the toner image may be fixed on the support member;

detector means for detecting the position of said toner image support member with respect to the widthwise direction thereof; and adjust means for adjusting the temperature difference between the opposite ends of at least one of said first and second rollers in accordance with the signal formed by said detector means, to thereby hold the thermally expanded states of said first and second rollers in such a thermally expanded condition that displacement of said toner image support member from a predetermined conveyance path in the widthwise direction of said support member may be prevented.

12. A device for heating and fixing a toner image on a support member, comprising:

first and second rollers at least one of which is thermally expansible for pressure-holding the toner image support member therebetween and conveying the same;

means for supporting said first and second rollers;

heating means for heating at least one of said first and second rollers to a temperature at which the toner image may be fixed on said support member;

rotational force transmitting means connected to the shaft on a first end of said first roller, said means being effective to transmit to said first roller the rotational force generated by a driving source to rotatively drive said first roller;

detector means for detecting the position of said toner image support member with respect to the widthwise direction thereof; and cooling means for cooling a second end of said first roller which is opposite to said first end in accordance with the signal formed by said detector means, to thereby hold the thermally expanded states of said first and second rollers in such a thermally expanded condition that displacement of the toner image support member from a predetermined conveyance path in the widthwise direction of said support member may be prevented.

13. The device according to claim 2 or 12, wherein said cooling means includes fan means.

14. The device according to claim 13, wherein means are provided for shielding said second roller from the wind formed by said fan means, and said fan means blows a cooling wind to the shaft on the second end of said first roller.

15. A device for heating and fixing a toner image on a support member, comprising:

first and second rollers, at least one of which is thermally expansible, for pressure-holding the toner image support member therebetween and conveying the same;

means for supporting said first and second rollers;

main heating means for heating at least one of said first and second rollers to a temperature at which the toner image may be fixed on the support member;

rotational force transmitting means connected to the shaft on a first end of said first roller, said means being effective to transmit the rotational force generated by a drive source to rotatively drive said first roller;

detector means for detecting the position of said toner image support member with respect to the widthwise direction thereof; and auxiliary heating means for imparting a greater amount of heat to said first end of said first roller than to a second end of said first roller which is opposite to said first end in accordance with the signal formed by said detector means, thereby holding the thermally expanded state of said first and second rollers in such a condition that said toner image support member is prevented from being displaced transversely from a predetermined conveyance path.

16. The device according to claim 11, 12 or 15, wherein said detector means is a means for detecting the temperature difference between the opposite ends of said first roller.

17. The device according to claim 11, 12 or 15, wherein said detector means is a means for detecting the position of the edge of the toner image support member with respect to the widthwise direction thereof at least one of a position upstream of the nip between said first and second rollers with respect to the conveyance path of the toner image support member and a position downstream of said nip.

18. A device according to claim 2, 6, 12 or 15, wherein said supporting means supports said first roller at a fixed position and said second roller is selectively press-contactable with said first roller, wherein when such second roller is press-contacted with said first roller, said second roller is rotated by the friction force therebetween in accordance with the rotation of said first roller, and said heating means heats said first roller.

19. A device according to claim 1, 2, 6, 11, 12 or 15, wherein said toner image support member is a web which extends from a feeding position to said fixing device through a station where it is provided with the toner image.

20. A device according to claim 18, wherein said second roller is provided with a layer of resilient material which is deformed by said first roller when press-contacted to said first roller.

21. A device according to claim 11, 12 or 15, wherein said detecting means detects the temperature difference between the opposite ends of at least one of said first and second rollers.

22. A device according to claim 1, 2 or 6, further comprising a plurality of temperature sensors for detecting the temperature of at least one of said first and second rollers, wherein said sensors are arranged at different positions along the length of the roller, and said device further comprising means for controlling said adjusting means using the signals produced by said sensors.

23. A device according to claim 22, wherein said sensors are provided at opposite ends of at least one of said first and second rollers, and said control means controls said adjusting means in accordance with the temperature difference provided by said sensors.

24. A device according to claim 1, 2 or 6, further comprising means for sensing the position of the image support member with respect to the direction of its width, said sensing means being located on at least one side of the nip of said first and second rollers, with respect to the direction of the toner image support member transportation, and means for controlling said adjusting means in accordance with said sensing means.

* * * * *